US005401013A

United States Patent [19]

Hurd et al.

[11] Patent Number: 5,401,013

[45] Date of Patent: Mar. 28, 1995

[54] ADDRESSING MACHINE FEED GAP SETTING

[75] Inventors: Bruce E. Hurd, Monroe; Lawrence F. Eisner, Cheshire, both of Conn.

[73] Assignee: Bryce Office Systems, Inc., Oxford, Conn.

[21] Appl. No.: 121,492

[22] Filed: Sep. 16, 1993

[51] Int. Cl.[6] ..... B65H 3/52

[52] U.S. Cl. ..... 271/124

[58] Field of Search ..... 271/124, 125, 104, 138, 271/10

[56] References Cited

U.S. PATENT DOCUMENTS

| | | | |
|---|---|---|---|
| 3,360,259 | 12/1967 | Stewart | 271/124 |
| 3,563,537 | 2/1971 | Thut | 271/124 |
| 3,838,851 | 10/1974 | Kolibas . | |
| 4,437,658 | 3/1984 | Olson . | |
| 4,858,907 | 8/1989 | Eisner et al. . | |
| 4,961,566 | 10/1990 | Labombarde | 271/124 |
| 4,991,831 | 2/1991 | Green | 271/125 |
| 5,078,381 | 6/1992 | Brabart et al. | 271/124 |
| 5,145,161 | 9/1992 | Bowser et al. | 271/124 |
| 5,163,669 | 11/1992 | Hurd et al. . | |

FOREIGN PATENT DOCUMENTS

| | | |
|---|---|---|
| 62-36246 | 2/1987 | Japan . |
| 2033348 | 5/1980 | United Kingdom . |

*Primary Examiner*—H. Grant Skaggs
*Attorney, Agent, or Firm*—Nixon & Vanderhye

[57] ABSTRACT

An addressing machine has separator blocks which cooperate with feed rollers to insure proper one-at-a-time feeding of media elements (e.g. envelopes) to a printer within the machine housing. The optimum feed gap between the separator blocks and rollers corresponds to the thickness of the particular envelopes being handled, and is quickly and positively adjusted using a pivoted lever having first and second locking cam surfaces spaced from each other by a release cam surface, the lever pivoted to a mounting block fixed to a front face of the housing which the separator blocks slide with respect to in guided movement. The cam surfaces act through a spring plate which has an opening frictionally receiving the mounting block, and having upwardly tapered ends and a bulge in the middle for engaging the cam surfaces.

21 Claims, 8 Drawing Sheets

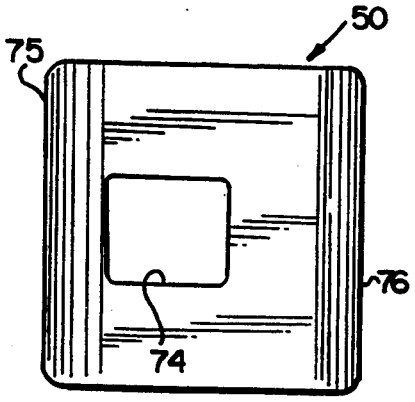
Fig. 7
Fig. 8
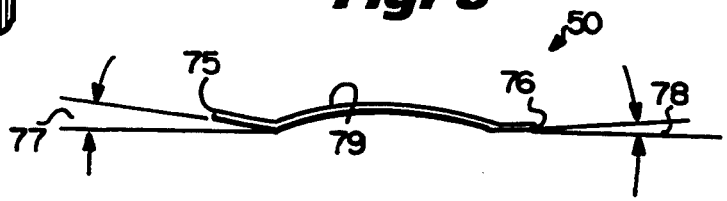
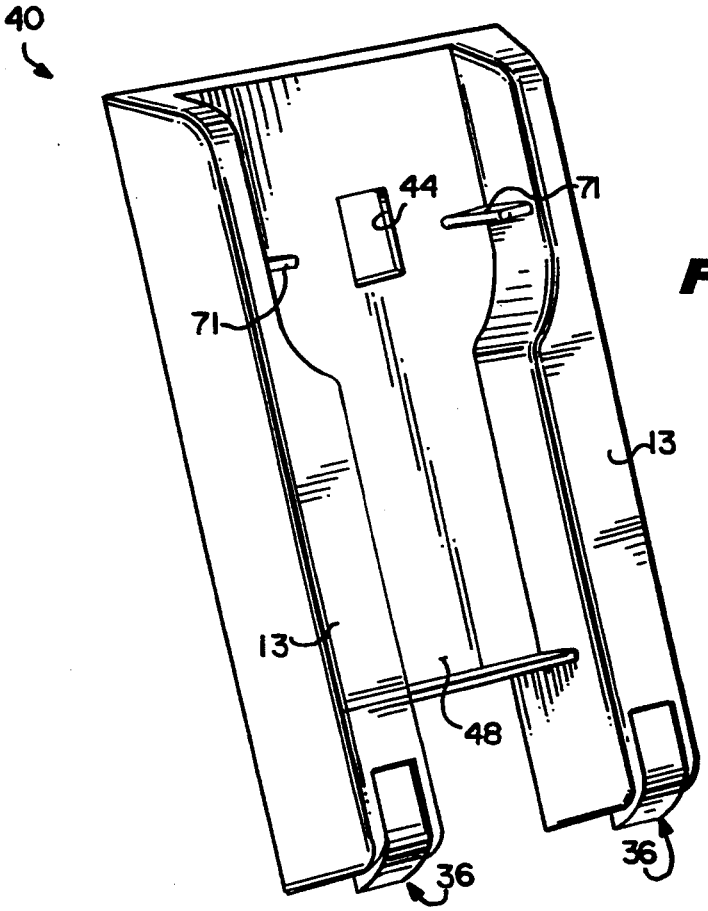
Fig. 9

ADDRESSING MACHINE FEED GAP SETTING

BACKGROUND AND SUMMARY OF THE INVENTION

In conventional addressing machines which print addresses (outgoing and/or return addresses) on media elements (envelopes, labels, sheets of paper to be inserted in window elements, etc.), in order to insure proper feeding of the media elements to the printer within the machine housing, it is necessary to adjust the feed gap. If the feed gap is not properly adjusted, either the media elements will not feed smoothly, or they will not feed one at a time, but either often or intermittently more than one media element will pass into the machine at once, resulting in blank envelopes, clogging or other malfunction of the printer or downstream handling elements, or the like.

Typically, the adjustment of the feed gap in addressing machines is a time consuming and/or inexact process. Normally adjustment is accomplished by turning a plurality of threaded elements, either to traverse the separator blocks which cooperate with feed rollers to set the feed gap, or to clamp the separator blocks in position. Use of the threaded elements is not only time consuming, when they are associated with a clamping component, oftentimes there is slippage between the components to be clamped together that is introduced during the tightening process.

According to the present invention, an apparatus and method are provided which allows quick and accurate setting of the feed gap of an addressing machine. Even though according to the invention there are a plurality (e.g. six) of separator blocks cooperating with feed rolls so as to accommodate media elements of all different sizes and positively (when properly adjusted) provide one at a time feeding of the elements, adjustment can be done very quickly due to the quick release and engage accurately positionable holding means that are provided for holding the separator blocks with respect to a face of the addressing machine housing. In a matter of seconds the machine can be adjusted to receive an exemplary thickness media element, an exemplary media element can be placed in proper position with respect to the rest of the feed rollers, and all the separator blocks can be moved into accurate position with respect to the sample media element and locked in place.

According to one aspect of the present invention, there is provided a feeding mechanism for feeding media elements one by one from a stack to be further acted upon, comprising the following components: A housing for mounting the feeding mechanism, and including components for supporting in a stack media elements to be fed one at a time. A plurality of feed rollers each having a peripheral surface, and each mounted for rotation about a substantially common first axis, the roller peripheral surfaces for engaging media elements and feeding them. A plurality of separator blocks associated with at least two of the feed rollers, each separator block having a bottom termination for engaging an edge of a media element in a stack supported by the housing and preventing feeding of media elements engaged thereby. Means for mounting the separator blocks to the housing for adjustable linear movement toward and away from the feed rollers, so that bottom terminations may be moved toward and away from the feed rollers to adjust the Linear spacings between the peripheral surfaces of the feed rollers and the bottom terminations; and quick release and engage means for quickly holding the separator blocks to the housing in infinitely variable positions to which they have been adjusted and quickly releasing them from the positions.

The quick release and engage means preferably comprises a lever having at least one locking cam surface, and at least one release cam surface; and means for mounting the lever for pivotal movement about a second axis (typically parallel to the first axis, and above it) which remains substantially stationary with respect to the housing; the locking cam surfaces radially spaced further from the second axis than the release cam surfaces.

The quick release and engage means also preferably further comprises a spring plate: which is substantially stationary with respect to the housing disposed between the cam surfaces of the lever and a separator block, and wherein the means for mounting the lever for pivotal movement mounts the lever so that when it is in a locking position the at least one locking cam surface engages and applies a force to the spring plate, which force causes the spring plate to press the separator block and cause frictional engagement between the separator block and the housing so that the separator block cannot move with respect to the housing, and so that when it is in a release position the at least one release cam surface engages the spring plate but supplies insufficient force to the spring plate to provide frictional engagement between a the separator block and the housing, thereby allowing the separator block to move under the force of its own weight with respect to the housing.

The means for mounting the lever for pivotal movement preferably comprises the following elements: a mounting block, having a surface configuration for receiving the spring plate so that an opening in the spring plate surrounds the surface configuration and is held tightly thereto by friction; a pivot pin extending through the block and the lever along the second axis; and means for releasably mounting the block to the housing. The means for releasably mounting the block to the housing preferably comprises a locator pin fixed to and extending outwardly from the block in a plane substantially perpendicular to the second axis; means defining a through extending bore in the block parallel to the locator pin; a locator pin-receiving opening in the housing; a threaded opening in the housing adjacent the locator pin-receiving opening; and a threaded fastener for passing through the bore and into threaded engagement with the threaded opening in the housing. The block surface configuration typically comprises opposite side surfaces of the block extending outwardly at an angle of between about 10–30 degrees (e.g. about 20 degrees).

The spring plate preferably comprises a plate having first and second end edges, both the edges angled slightly upwardly from a plane passing through the plate, and a radiused bulge provided intermediate the first and second end edges and extending upwardly from the plane.

The at least one locking cain surface, in order to provide easy locking with two different orientations of the lever so that it is clear which levers have been finally adjusted and which have not, preferably comprises first and second locking cam surfaces separated by the release cam surface extending around a peripheral portion of the lever in an arc with the second axis as its center.

The mechanism according to the invention also preferably further comprising a common slide mechanism containing two of the separator blocks, and holding them together in spaced relationship so that the bottom terminations thereof are aligned with two of the rollers. For example, three of the common slide mechanisms are provided mounted to the housing, and the plurality of rollers includes six rollers, one for the bottom termination of each separator block associated with each of the three common slide mechanisms. Each common slide mechanism may comprise an injection molded plastic element, including means defining a plurality of cavities therein adjacent the bottom terminations of the separator blocks; and further comprising a plurality of weights having a density much greater than the density of the injection molded plastic, the weights frictionally received in at least some of the cavities.

The first and second axes are commonly both substantially horizontal, and the means for guiding movement of the separator blocks comprises means defining a vertically elongated opening in the common slide element having a vertical dimension significantly greater than the vertical dimension of the pivot block, a vertically elongated guide tab extending from a surface of the slide element engaging the housing, and a vertically elongated slot in the housing having a vertical dimension longer than the vertical extent of the guide tab, and receiving the guide tab therein.

As earlier described, the housing is typically a housing mechanism for a printer for automatically printing addresses on media fed thereto, the feed rollers feeding media from a stack supported by the housing to the printer.

According to another, more general, aspect of the present invention, there is provided a quick engage and release locking mechanism for applying a normal force to a movable surface to hold that movable surface to a substantially parallel stationary surface. This mechanism has the following components: A lever having at least one locking cam surface, and at least one release cam surface. Mounting means for mounting the lever for pivotal movement with respect thereto, the mounting means comprising a mounting block and a pivot pin connecting the lever to the block and defining a pivot axis of the cam surfaces with respect to the mounting block. The locking cam surfaces are radially spaced further from the pivot axis than the release cam surfaces. The mounting block have an exterior surface configuration. A spring plate having means defining a through extending opening therein generally corresponding to the exterior surface configuration of the mounting block; and the mounting block extends through the spring plate opening with the mounting block exterior surface configuration frictionally engaging the spring plate, and at least the locking cam engaging the spring plate as the lever pivots about the axis.

The mechanism also preferably further comprises a locator pin extending outwardly from the mounting block in a plane substantially perpendicular to the axis; and means defining a through extending opening in the mounting block, for receipt of a fastener shaft, parallel to and adjacent the locator pin, and the exterior surface configuration may comprise a surface portion having opposite sides extending outwardly at an angle of about 10–30 degrees, the surface portion frictionally engaging the spring plate at the opening. Most desirably, the lever comprises first and second locking cam surfaces separated from each other by the release cam surface, and the spring plate comprises a plate having first and second end edges, both the edges angled slightly upwardly from a plane passing through the plate, and a radiused bulge provided intermediate the first and second end edges and extending upwardly from the plane, the bulge engaging the cam surfaces.

According to yet another aspect of the present invention, a method of adjusting the feed gap on an addressing machine is provided. The addressing machine has a plurality of separator blocks for engaging media elements in a stack and ensuring one at a time feeding of the media elements, cooperating with a plurality of feed rollers, the separator blocks having bottom terminations and mounted in engagement with a face of a housing, which face is substantially perpendicular to the direction of feed of media elements by the feed rollers, and quick release and engage locking elements associated with the separator blocks each including a lever having first and second locking cam surfaces separated by a release cam surface, a mounting block fixed to the housing face and extending through an opening in the separator block, a pivot pin defining a pivot axis about which the lever pivots with respect to the mounting block and housing, the locking cam surfaces spaced further distances from the pivot axis than the release cam surface, and a spring plate between the cam surfaces and the separator block and held stationary by the mounting block. The method comprising the steps of substantially sequentially:

(a) moving each of the levers to positions in which the release cam surfaces engage the spring plate;

(b) sliding each of the separator blocks to an upward position in which the bottom terminations are spaced a distance from a cooperating roller larger than the expected thickness of any media element to be handled by the addressing machine;

(c) pivoting each lever about its pivot axis to a position in which the second locking cam surface engages the spring plate and applies a force through the spring plate holding its associated separator block in the upward position;

(d) with the rollers not running, placing an exemplary thickness media element on the rollers, beneath the separator block bottom terminations;

(e) pivoting each of the levers to the positions of step (a), thereby releasing the force holding the separator blocks in their upward positions, so that the separator blocks fall of their own weight into downward positions in which the bottom terminations thereof engage the media element resting on the rollers; and (f) pivoting each lever about its pivot axis to a position in which the first locking cam surface engages the spring plate and applies a force through the spring plate holding its associated separator block in the downward position, which defines a feed gap of approximately the thickness of each media element to be fed one at a time into the addressing machine by the feed rollers.

According to one particular procedure of the invention, six separator blocks are provided, mounted in pairs on three common slide elements, each common slide element having one of the levers associated therewith, and each of steps (a)–(f) is practiced for all three of the slide elements before any subsequent step is practiced for any of the slide elements.

It is a primary object of the present invention to provide a quick and accurate apparatus and method for setting the feed gap for media elements, particularly to an addressing machine. This and other objects of the invention will become clear from an inspection of the detailed description of the invention, and from the appended claims.

BRIEF DESCRIPTION OF THE DRAWINGS

FIGS. 7 and 8 are top plan, and side, views, respectively, of an exemplary spring plate of the quick release and engage positioning means according to the invention;

FIGS. 9 and 10 are top perspective and rear plan views, respectively, of the common slide mechanism of FIGS. 3–6;

DETAILED DESCRIPTION OF THE DRAWINGS

Figure 1:
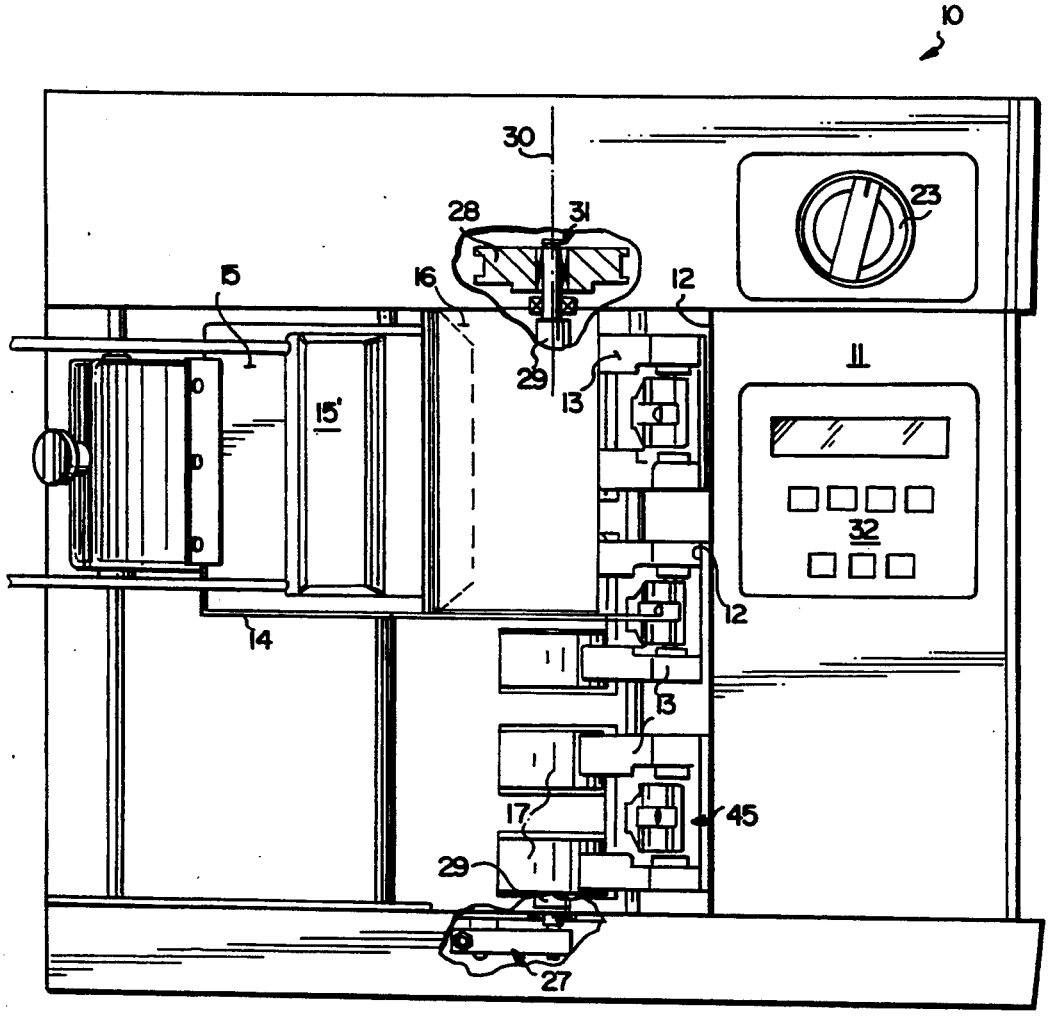
FIG. 1 is a top plan view of an addressing machine incorporating the teachings of the invention.
Figure 2:
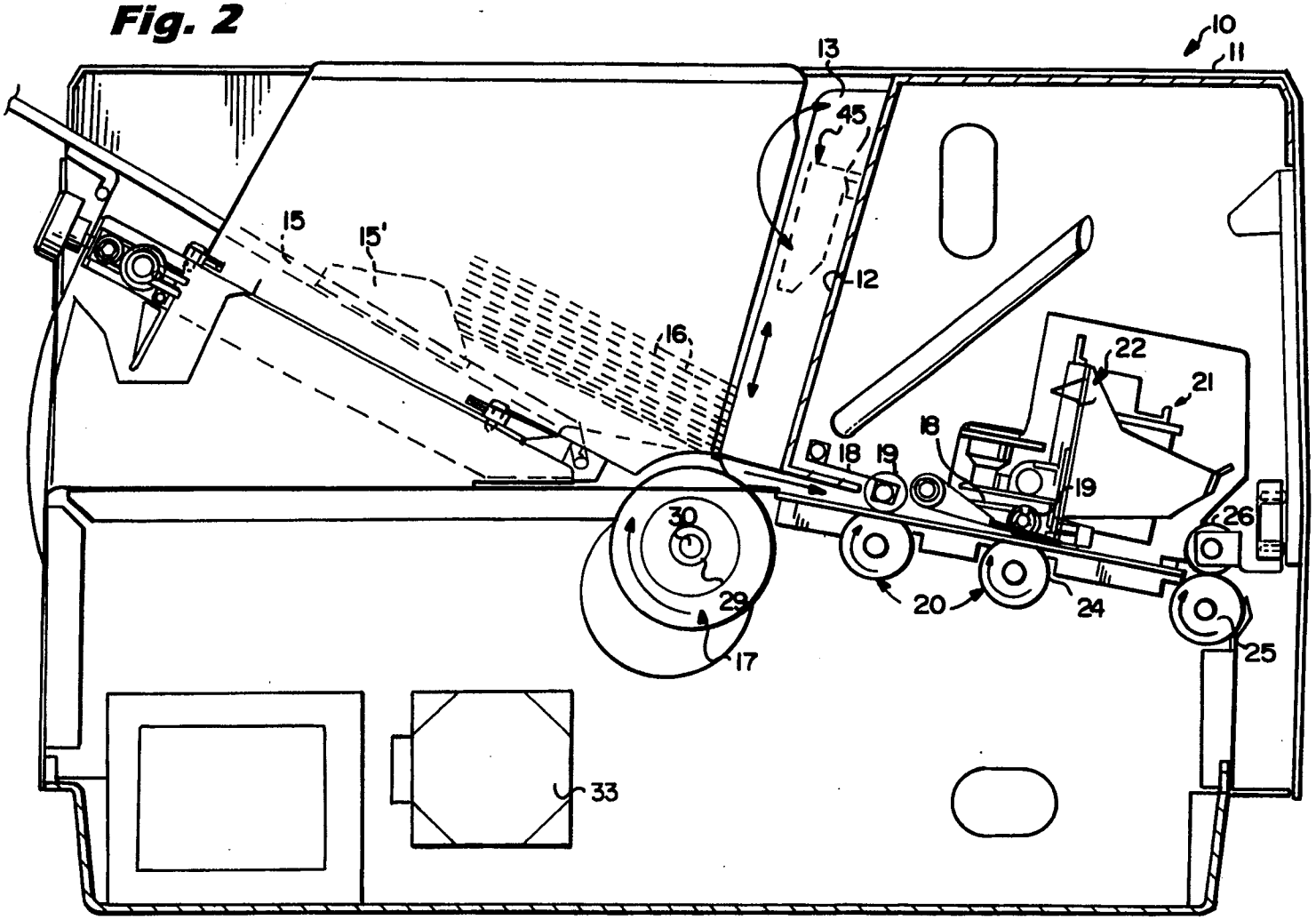
FIG. 2 is a side view, partly in cross-section and partly in elevation, of the machine of FIG. 1.
Figure 3:
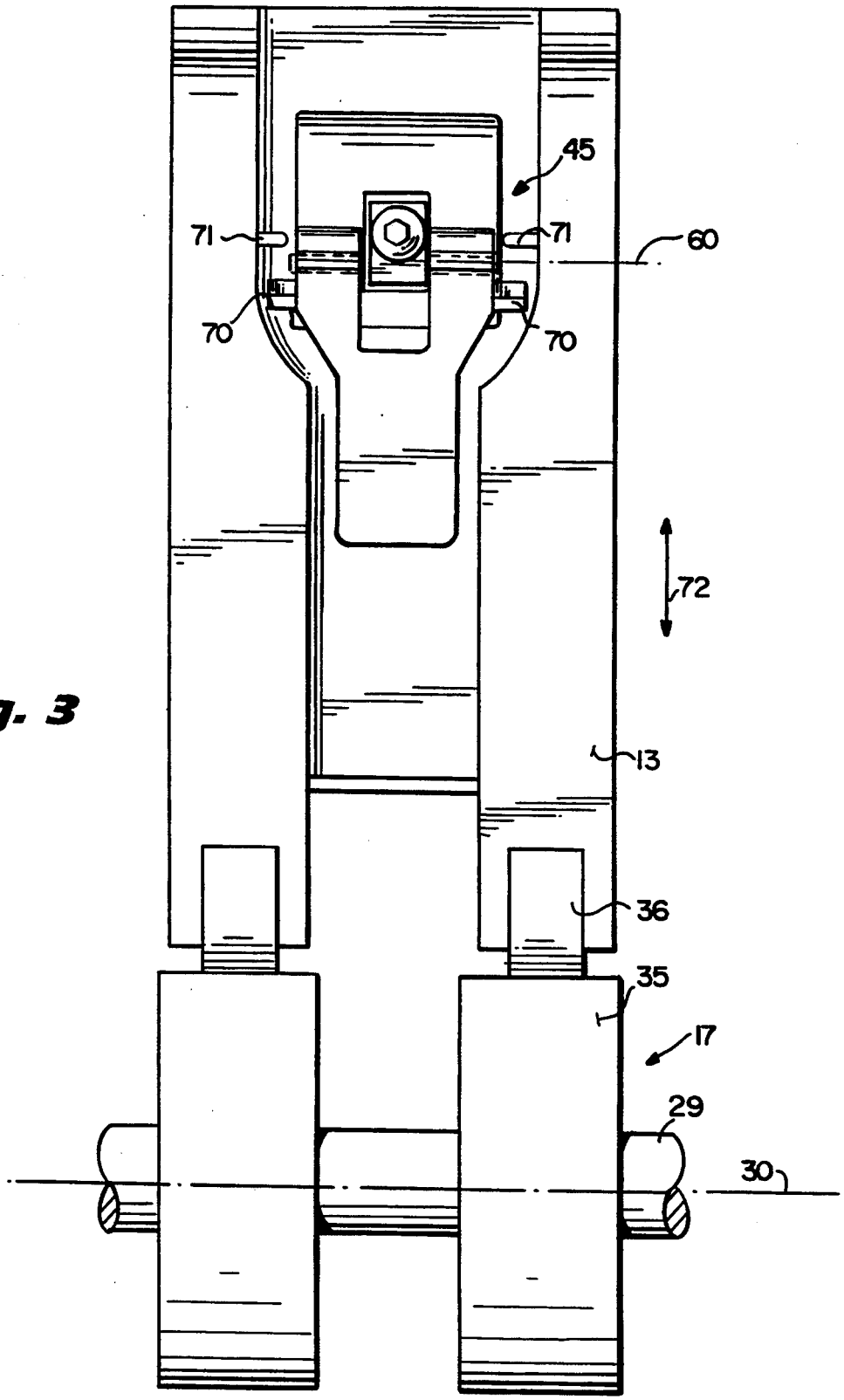
FIG. 3 is a front detail view of one common slide element with quick release and engage accurate positioning means according to the invention.

FIGS. 1 and 2 illustrate an exemplary addressing machine which may employ the apparatus and be used to practice the method according to the present invention. The machine, shown generally by reference numeral 10, is only exemplary, and it is to be understood that the invention may be employed with almost any machine in which the quick and accurate adjustment of a feed gap is necessary or desirable.

The machine 10 includes a housing 11, including having a front face 12 with which separator blocks 13 cooperate, a media fence 14, and a feed platform 15 with a feed ramp 15' thereon comprising components of the housing 11 for vertically stacking media elements 16—which will be hereafter referred to as envelopes, but may also include labels, paper sheets for insertion into window envelopes, and the like—which are to be acted upon by the machine 10. A plurality of feed rollers 17 (e.g. six rollers, typically one block 13 associated and aligned with each roller 17) are provided at the bottom of the stack of envelopes 16 to initially feed the envelopes into the machine 10.

The internal mechanisms of the machine 10 for feeding and printing the envelopes 16, one at a time, may include leaf springs 18 for mounting idler rollers 19, and cooperating with tungsten carbide coated transport rollers 20. The print head 21 is mounted on a shuttle mechanism 22 which moves up and down is response to rotation of the thickness adjustment knob 23. A photosensor 24 senses the locations of the edges of the envelopes 16 during feeding and controls the print mechanism and the transport rolls in response to the envelope 16 position. Downstream of the print head 21 is a rubber transport roller 25 which cooperates with the exit, envelope-hold down, roller 26 to positively discharge an address-printed (outgoing and/or return) envelope 16 from the machine 10 into a completed envelope stack or location.

As is known per se, and seen in FIG. 1, a friction brake 27 may be associated with the feed rollers 17 to stop inertial rotation of the feed rollers once power to them has been cut off, and the drive pulley 28 for driving the shaft 29 defining the common horizontal axis 30 about which the rollers 17 rotate is connected to the shaft 29 by a one-way clutch 31. The control panel 32 for controlling all of the powered components, including the stepper motor 33 (FIG. 2), may be mounted on top of the housing 11.

The feed gap 34 (see FIG. 4) is the spacing (basically vertical) between the roller 17 peripheral surface 35 and the bottom terminations 36 of each of the separator blocks 13. The terminations 36 preferably are 95 durometer polyurethane or other medium friction material, and each has an inward curvature of the envelope engaging surfaces 37 thereof. According to the invention, it is desirable to set the feed gap 34 so that it is essentially equal to the thickness 38 of the envelopes 16 to be fed to the machine 10.

Figure 10:
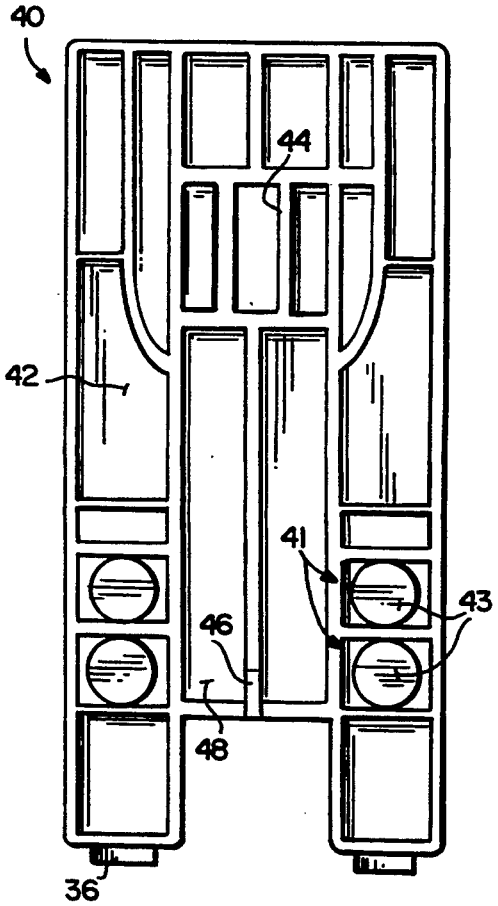
Figure 11:
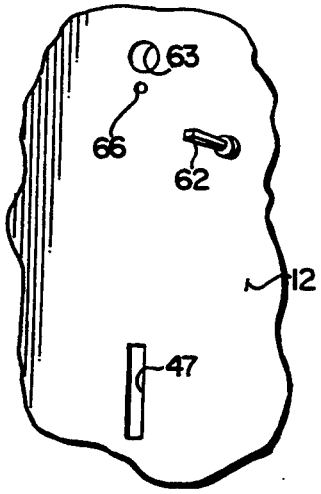
FIG. 11 is a front detail view of that portion of the face of the housing of the machine of FIGS. 1 and 2 having adaptations for receipt of the slide mechanism and positioning means of FIGS. 3–10.
Figure 12:
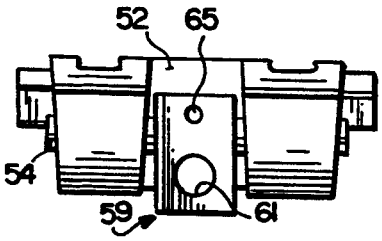
FIGS. 12 and 13 are front end and side views, respectively, of the lever and mounting block components of an exemplary positioning means according to the invention.
Figure 13:
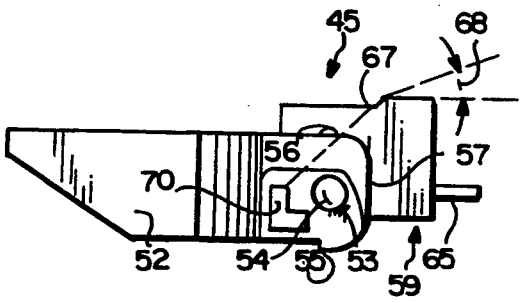

In the embodiment illustrated in the drawings, two blocks 13 are preferably mounted together as a common slide mechanism 40 (shown alone in FIGS. 9 and 10, and with other components in FIGS. 1–6); that is three such slide mechanisms 40 are provided. Each slide mechanism 40 is preferably injection molded out of relatively rigid plastic, and has cavities 41 molded into the back surface 42 thereof (see FIG. 10) near the bottom terminations 36 for frictionally engaging cylindrical weights 43 of a material much denser than the plastic of the mechanism 40 (e.g. steel cylinders 43). The weights 43 ensure that the mechanisms 40 drop quickly if not pressed into frictional engagement with housing face 12. The mechanism 40 also has a rectangular vertically elongated slot 44 provided near the top thereof for cooperation with the quick release and engage accurate positioning means 45 (FIGS. 1–8, 12 and 13) according to the invention, while the integral vertically elongated guide tab 46 (FIG. 10) on the back 42 cooperates with a vertically elongated guide slot 47 formed in the face 12 (see FIGS. 4–6 and 11). The slot 44 and tab 46 are formed in the web 48 connecting the blocks 13 forming the slide 40.

The quick release and engage positioning means 45 does not use screw threaded adjustment, but rather using a basically overcenter lever action, so that adjustment is much quicker than with a screw threaded adjustable element, and by utilizing a particular spring plate 50 (FIGS. 4–8), will accurately move into latched position without the lever movement causing movement of the components during the latching action.

The means 45 (see FIGS. 3–8, 12 and 13 in particular) preferably comprises a lever 52, e.g. molded in one piece from hard plastic, having a through extending bore 53 through which a pivot pin 54 extends when the means 45 is assembled, and having at least one locking cam surface and at least one release cam surface. Preferably first and second locking cam surfaces 55, 56, respectively, are provided spaced from each other by a single release cam surface 57, the surfaces 55, 56 being a larger radial distance from the bore 53 than the surface 57.

The pivot pin 54 is received within a mounting block 59, which mounts the lever for pivotal movement about an axis 60 defined by the pin 54, the axis 60 typically parallel to (and above) the axis 30. The block 59 preferably is a block of aluminum, and in addition to having a bore receiving the pin 54 has a through extending opening 61 adapted to receive a screw threaded fastener (e.g. 62 in FIG. 11) which passes through it and into engagement with a screw threaded opening 63 in face 12 of housing 11 (see FIG. 11). The block 59 also has a metal locator pin 65 (see FIGS. 12 and 13) extending from it parallel to the opening 61 and adapted to be received within the locator opening 66 (see FIG. 11) in the face 12. The block 59 also has an exterior surface configuration including an outwardly tapering portion 67. The portion 67 typically makes an angle 68 (FIG. 13) with respect to a line parallel to bore 61, the angle 68 preferably being between about 10–30 degrees (e.g. 20 degrees).

The lever 52 also preferably has ears 70 integral therewith which may cooperate with stops 71 (see FIG. 9 in particular) molded as part of slide 40 to stop the movement of the slide 40 in the direction 72 toward and away from the rollers 17.

The spring plate 50 is stationary mounted with respect to the block 59 (and thus to the housing face 12) preferably as a result of the edges thereof defining the opening 74 therein (see FIG. 7) engaging the block 59 at the tapered surface portion 67 thereof. This engagement causes the components 50, 59 to become even more tightly fixed to each other over time. The plate 50 is typically of stainless steel spring stock having a thickness of about 0.15 inches, and has first and second end edges 75, 76 that are turned upwardly at angles 77, 78 with respect to a plane extending through the center of the plate 50, the angle 77 typically being about seven degrees, and the angle 78 about four degrees. Between the end edges 75, 76 is a bulge 79 extending upwardly (in the same direction that the edges 75, 76 are turned), and preferably radiused (e.g. having a radius of 1.4–1.5 inches).

Figure 4:
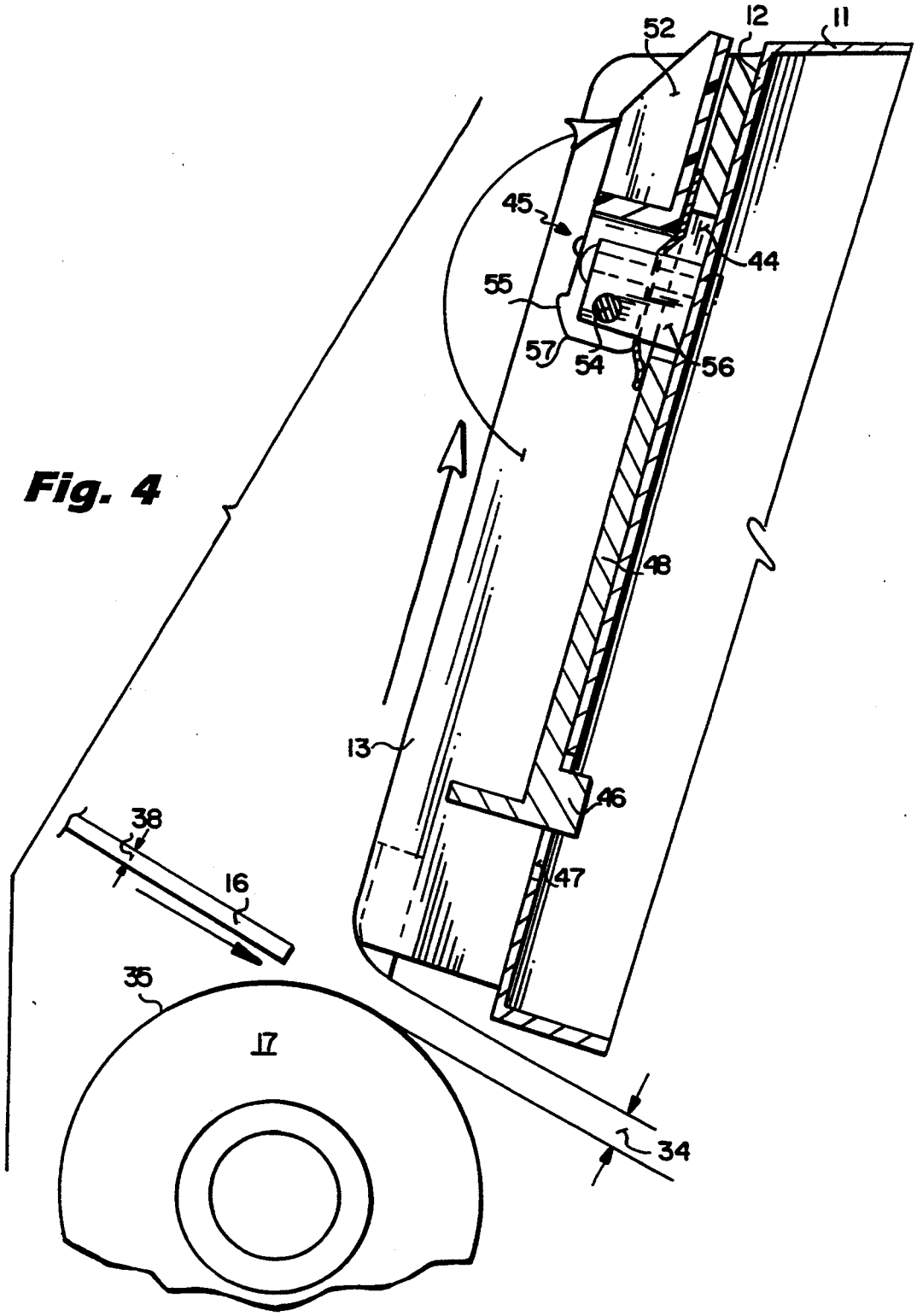
FIGS. 4–6 are sequential views showing movement of a common slide mechanism, and the relative positions of a quick release and engage positioning means, during practice of an exemplary method of setting the feed gap for the machine of FIGS. 1 and 2, according to the invention.

Use of the structures according to the present invention to quickly and accurately set the feed gap 34 will now be described particularly with respect to FIGS. 4–6. The levers 52 are each grasped in turn and moved to the position illustrated in FIG. 5 in which the release cam surface 57 aligns with spring 50 bulge 79, in this position not applying any friction enhancing force to the slide 40, so that it is free to slide on the face 12. Each of the slides 40 are then moved upwardly to the position illustrated in FIG. 4, and then the lever 52 is rotated completed clockwise to the position illustrated in FIG. 4 in which the second locking cam surface 56 engages the spring 50 bulge 79, applying a large force pressing the back 42 of the slide 40 into contact with the face 12, and thereby preventing the slide 40 from moving from the position illustrated in FIG. 4. In this position the gap 34 is maximum.

Figure 5:
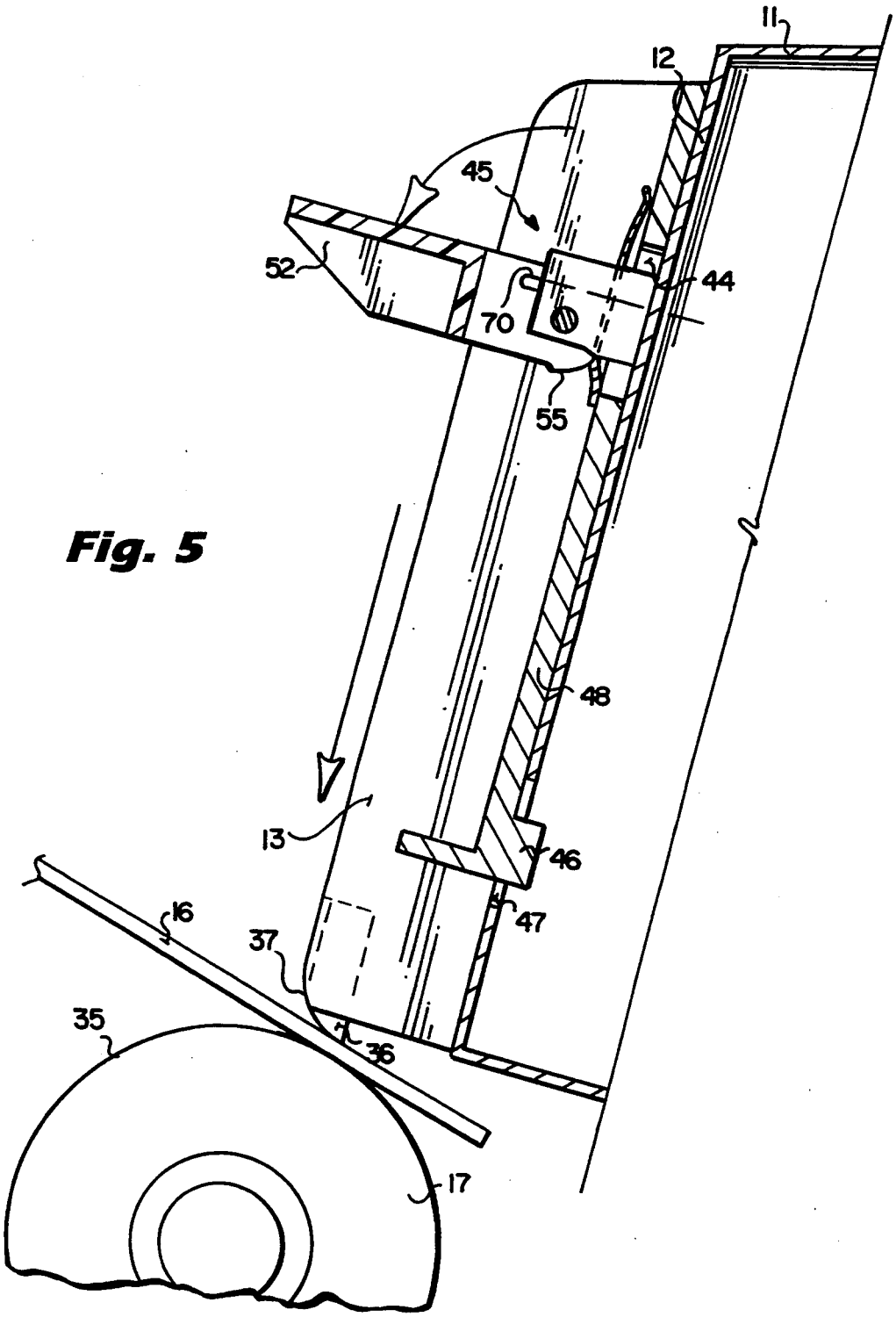

A fully exemplary envelope 16 is then selected (i.e. truly representative of the envelopes 16 that will be fed to the machine 10) and placed on the peripheral surfaces 35 of the rollers 17 (while they are turned off), as seen in FIG. 5. Then the levers 52 are each grasped, in turn, and rotated counterclockwise to the perpendicular position illustrated in FIG. 5, in which, again, the release cam surface 57 aligns with the bulge 79, The slides 40 then fall of their own weight (enhanced by the weights 43) until the bottom terminations 36 thereof engage the top of the envelope 16, as seen in FIG. 5. This defines the proper feed gap 34, and it is now necessary to lock the slides 40 in this position.

Figure 6:
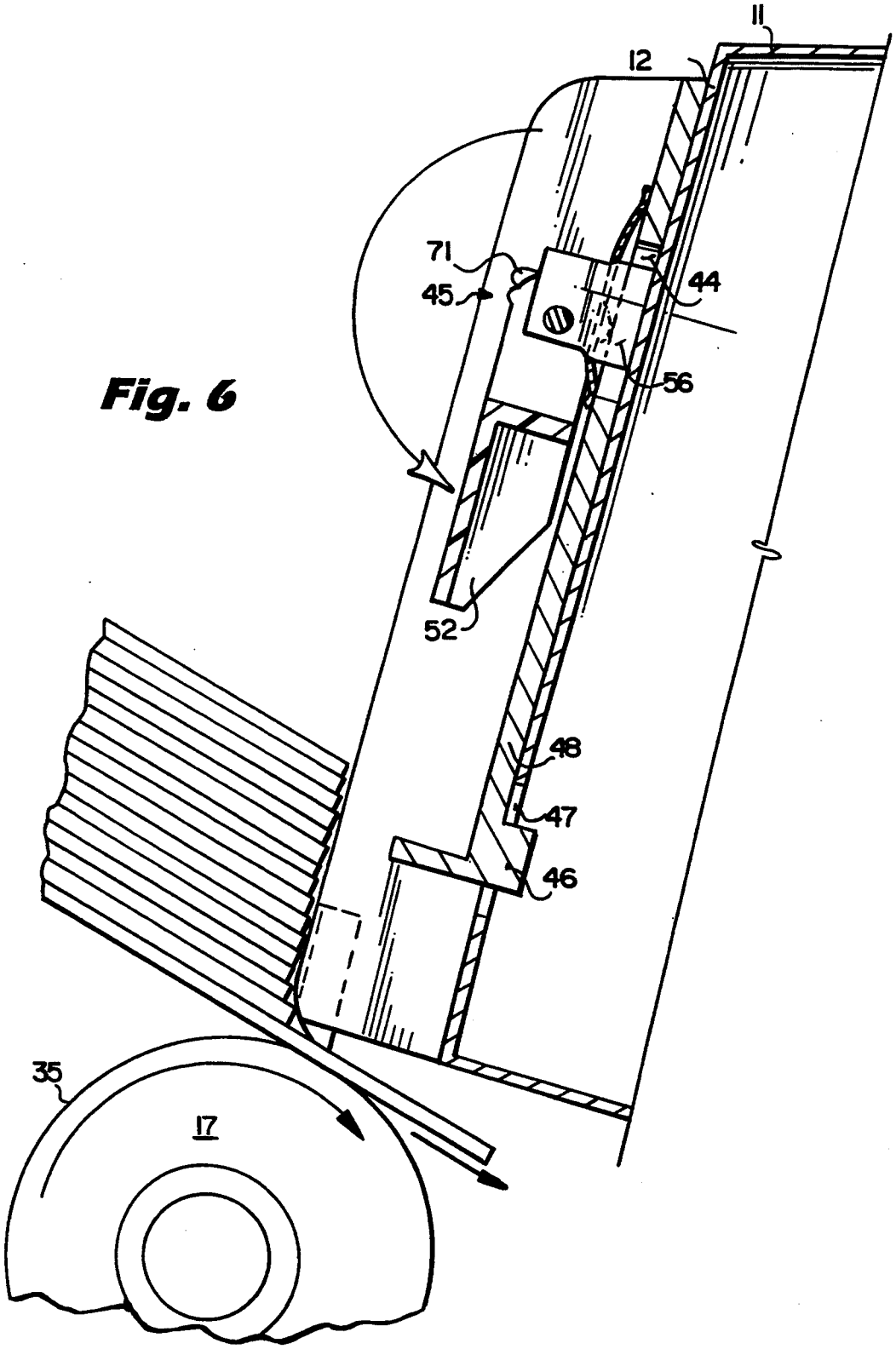

The slides 40 are, in turn, locked in the position illustrated in FIG. 5, as shown in FIG. 6, by rotating the levers 52 fully counterclockwise to the position illustrated in FIG. 6, wherein the first locking cam surface 55 engages the spring bulge 79, applying through the spring 50 a force to the slide 40 such that there is high friction between the back 42 of the slide 40 and the face 12, thereby precluding movement of the slide 40 from the position illustrated in FIG. 6. Then the envelopes 16 may be stacked on the feed surface 15, and as shown in FIG. 6 will be fed one at a time by the rollers 17 into the machine 10, the separator blocks 13 precluding more than one-at-a-time feeding since the feed gap 34 is properly set. Because of the spring 50, when the lever 52 is moved from the FIG. 5 position to the FIG. 6 position, there will be no dislocation of the slide 40, but rather it will remain positively and accurately in place.

Operation of the machine 10 after stacking of envelopes 16 on surface 15 is initiated by placing the sliding fence 14 into close proximity with the edges of the stacked envelopes for edge guiding, and then the machine 10 is turned on via control panel 32, all of the rollers 17, 20, 25 running simultaneously. The rollers 17 transport the bottom-most envelope 16 in the stack while the separator block portions 36 old back the other envelopes. The leading edge of the first envelope 16 enters the nip of the first set of transport rolls 20, 19, and because the transport rolls are running at a faster surface speed than the rolls 17 the envelope 16 speeds up. This is done with little frictional drag effect from the feed rollers 17 due to the fact that they are driven through the one-way clutch bearing 31. The increase in envelope speed during transport provides a gap between successive envelopes allowing sensor 24 to distinguish the trailing edge of one piece from the leading edge of the next. When the leading edge of an envelope triggers sensor 24 the stepper motor 33 will continue feeding the envelope in "slew mode" to the position of the first line of print, and then stop and allow the print head 21 to translate across the envelope and print outgoing and/or return addresses. While printing is occurring, the envelope is transported one step at a time by motor 33 and rollers 19, 20, etc. In between fields of print and while exiting the machine 10 between rolls 25, 26 the motor 33 runs in a faster "slew mode" to increase machine throughput.

It will thus be seen that according to the present invention a method and apparatus providing quick yet accurate adjustment of the feed gap to an addressing machine, or the like, have been provided. While the invention has been herein shown and described in what is presently conceived to be the most practical and preferred embodiment thereof, it is to be understood that the invention is to be entitled to the broadest interpretation of the appended claims so as to encompass all equivalent structures and methods.

What is claimed is:

1. A feeding mechanism for feeding media elements one by one from a stack to be further acted upon, comprising:

a housing including components for supporting in a stack media elements to be fed one at a time;

a plurality of feed rollers each having a peripheral surface, and each mounted for rotation about a substantially common first axis, the roller peripheral surfaces for engaging media elements and feeding them;

a plurality of separator block associated with at least two of said feed rollers, each separator block having a bottom termination for engaging an edge of a media element in a stack supported by said housing and preventing feeding of media elements engaged thereby;

means for mounting said separator blocks to said housing for adjustable linera movement toward and away from said feed rollers, so that bottom terminators may be moved toward and away from said feed rollers to adjust the linear spacings between the peripheral surfaces of said feed rollers and said bottom terminations; and quick release and engage means for quickly and accurately holding said separator blocks to said housing in infinitely variable positions to which they have been adjusted and quickly releasing them from said positions, comprising a lever having at least one locking cam surface, and at least one release cam surface; and means for mounting said lever for pivotal movement about a second axis which remains substantially stationary with respect to said housing; said locking cam surfaces radially spaced further from said second axis than said release cam surfaces.

2. A mechanism as recited in claim 1 wherein said quick release and engage means further comprises a spring plate which is substantially stationary with respect to said housing disposed between said cam surfaces of said lever and a said separator block, and wherein said means for mounting said lever for pivotal movement mounts said lever so that when it is in a locking position said at least one locking cam surface engages and applies a force to said spring plate, which force causes said spring plate to press a said separator block and cause frictional engagement between said separator block and said housing so that said separator block cannot move with respect to said housing, and so that when it is in a release position said at least one release cam surface aligns with said spring plate but supplies insufficient force to said spring plate to provide frictional engagement between a said separator block and said housing, thereby allowing said separator block to move under the force of its own weight with respect to said housing.

3. A mechanism as recited in claim 2 wherein said means for mounting said lever for pivotal movement comprises: a said mounting block; said block having a surface configuration for receiving said spring plate so that an opening in said spring plate surrounds said surface configuration and is held tightly thereto by friction; a pivot pin extending through said mounting block and said lever along said second axis; and means for releasably mounting said mounting block to said housing.

4. A mechanism as recited in claim 3 wherein said means for releasably mounting said mounting block to said housing comprises a locator pin fixed to and extending outwardly from said block in a plane substantially perpendicular to said second axis; means defining a through extending bore in said mounting block parallel to said locator pin; a locator pin-receiving opening in said housing; a threaded opening in said housing adjacent said locator pin-receiving opening; and a threaded fastener for passing through said bore and into threaded engagement with said threaded opening in said housing.

5. A mechanism as recited in claim 3 wherein said block surface configuration comprises opposite side surfaces of said block extending outwardly at an angle of between about 10–30 degrees.

6. A mechanism as recited in claim 5 wherein said spring plate comprises a plate having first and second end edges, both said edges angled slightly upwardly from a plane passing through said plate, and a radiused bulge provided intermediate said first and second end edges and extending upwardly from said plane, said bulge engaging said cam surfaces.

7. A mechanism as recited in claim 3 further comprising a common slide mechanism containing two of said separator blocks, and holding them together in spaced relationship so that the bottom terminations thereof are aligned with two of said rollers.

8. A mechanism as recited in claim 7 wherein three of said common slide mechanisms are provided mounted to said housing, and said plurality of rollers includes six rollers, one for the bottom termination of each separator block associated with each of said three common slide mechanisms.

9. A mechanism as recited in claim 7 wherein said common slide mechanism comprises an injection molded plastic element, including means defining a plurality of cavities therein adjacent said bottom terminations of said separator blocks; and further comprising a plurality of weights having a density much greater than the density of said injection molded plastic, said weights frictionally received in at least some of said cavities.

10. A mechanism as recited in claim 7 wherein said first and second axes are both substantially horizontal; and wherein said means for guiding movement of said separator blocks comprises means defining a vertically elongated opening said common slide element having a vertical dimension significantly greater than the vertical dimension of said pivot block, a vertically elongated guide tab extending from a surface of said slide element engaging said housing, and a vertically elongated slot in said housing having a vertical dimension longer than the vertical extent of said guide tab, and receiving said guide tab therein.

11. A mechanism as recited in claim 2 wherein said spring plate comprises a plate having first and second end edges, both said edges angled slightly upwardly from a plane passing through said plate, and a radiused bulge provided intermediate said first and second end edges and extending upwardly from said plane.

12. A mechanism as recited in claim 2 wherein said at least one locking cam surface comprises first and second locking cam surfaces separated by said release cam surface extending around a peripheral portion of said lever in an arc with said second axis as its center.

13. A mechanism as recited in claim 12 wherein said first and second axes are parallel.

14. A mechanism as recited in claim 2 wherein said housing is a housing mechanism for a printer for automatically printing addresses on media fed thereto, said feed rollers feeding media from a stack supported by said housing to said printer.

15. A mechanism as recited in claim 1 wherein said at least one locking cam surface comprises first and second locking cam surfaces separated by said release cam surface extending around a peripheral portion of said lever in an arc with said second axis as its center.

16. A mechanism as recited in claim 15, wherein said first and second axes are parallel.

17. A mechanism as recited in claim 16 wherein said housing is a housing mechanism for a printer for automatically printing addresses on media fed thereto, said feed rollers feeding media from a stack supported by said housing to said printer.

18. A mechanism as recited in claim 1 wherein said first and second axes are parallel.

19. A mechanism as recited in claim 1 wherein said housing is a housing mechanism for a printer for automatically printing addresses on media fed thereto, said feed rollers feeding media from a stack supported by said housing to said printer.

20. A method of adjusting the feed gap on an addressing machine having a plurality of separator blocks for engaging media elements in a stack and ensuring one at a time feeding of the media elements, cooperating with a plurality of feed rollers, the separator blocks having bottom terminations and mounted in engagement with a face of a housing, which face is substantially perpendicular to the direction of feed of media elements by the feed rollers, and quick release and engage locking elements associated with the separator blocks each including a lever having first and second locking cam surfaces separated by a release cam surface, a mounting block fixed to the housing face and extending through an opening in the separator block, a pivot pin defining a pivot axis about which the lever pivots with respect to the mounting block and housing, the locking cam surfaces spaced further distances from the pivot axis than the release cam surface, and a spring plate between the cam surfaces and the separator block and held stationary by the mounting block, said method comprising the steps of substantially sequentially:

(a) moving each of the levers to positions in which the release cam surfaces align with the spring plate;

(b) sliding each of the separator blocks to an upward position in which the bottom terminations are spaced a distance from a cooperating roller larger than the expected thickness of any media element to be handled by the addressing machine;

(c) pivoting each lever about its pivot axis to a position in which the second locking cam surface engages the spring plate and applies a force through the spring plate holding its associated separator block in the upward position;

(d) with the rollers not running, placing an exemplary thickness media element on the rollers, beneath the separator block bottom terminations;

(e) pivoting each of the levers to the positions of step (a), thereby releasing the force holding the separator blocks in their upward positions, so that the separator blocks fall of their own weight into downward positions in which the bottom terminations thereof engage the media element resting on the rollers; and (f) pivoting each lever about its pivot axis to a position in which the first locking cam surface engages the spring plate and applies a force through the spring plate holding its associated separator block in the downward position, which defines a feed gap of approximately the thickness of each media element to be fed one at a time into the addressing machine by the feed rollers.

21. A method as recited in claim 20 wherein six separator blocks are provided, mounted in pairs on three common slide elements, each common slide element having one of the levers associated therewith; and wherein each of steps (a)–(f) is practiced for all three of the slide elements before any subsequent step is practiced for any of the slide elements.

* * * * *